US006363893B1

(12) United States Patent
Xin et al.

(10) Patent No.: US 6,363,893 B1
(45) Date of Patent: Apr. 2, 2002

(54) WATER JACKET FOR MULTI-CYLINDER INTERNAL COMBUSTION ENGINE

(75) Inventors: Jun Xin, Powell; Stephen Shih, Marysville; Michio Kawamoto, Powell; Yoshio Maeda, Dublin; Edwin Itano, Hilliard, all of OH (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/824,974

(22) Filed: Apr. 3, 2001

(51) Int. Cl.[7] ..... F02F 1/36
(52) U.S. Cl. ..... 123/41.82 R; 123/193.5
(58) Field of Search ..... 123/41.82 R, 193.5

(56) References Cited

U.S. PATENT DOCUMENTS 2,030,894 A * 2/1936 Pennebaker ..... 123/173
4,553,505 A 11/1985 Hirano et al.
4,567,859 A * 2/1986 Taguchi et al. ..... 124/41.82 R
4,690,104 A 9/1987 Yasukawa
4,889,079 A 12/1989 Takeda et al.
5,086,733 A 2/1992 Inoue et al.
5,799,627 A 9/1998 Dohn et al.
5,868,106 A 2/1999 Poropatic et al.

FOREIGN PATENT DOCUMENTS

JP 56-148647 11/1981

* cited by examiner

*Primary Examiner*—Tony M. Argenbright
*Assistant Examiner*—Katrina B. Harris
(74) *Attorney, Agent, or Firm*—Rankin, Hill, Porter & Clark LLP

(57) ABSTRACT

An improved water jacket structure for a cylinder head that assists in transferring heat from a lower wall of the cylinder head to coolant flowing through passageway in the head. The passageway is defined in the cylinder head by the lower wall and an upper wall. The lower wall provides a plurality of cylinder top walls that overlie corresponding ones of the cylinders in the engine block. The upper wall includes a series of ribs that extend from the upper wall toward the lower wall. The ribs include an inlet rib, and a set of interconnected ribs. The interconnected ribs are disposed between adjacent cylinder topwalls. The set of interconnected ribs have first ends that are connected to one another, second ends that are spaced from one another, and a lower edge that is spaced a predetermined distance from the lower wall.

18 Claims, 4 Drawing Sheets

WATER JACKET FOR MULTI-CYLINDER INTERNAL COMBUSTION ENGINE

BACKGROUND OF THE INVENTION

1. Field of the Invention

The present invention generally pertains to internal combustion engine cooling arrangements and, more particularly, to water jackets for multi-cylinder internal combustion engines.

2. Description of Related Art

Consistent and even cooling is necessary for proper operation of an internal combustion engine. More specifically, if the engine cylinder temperature is too high, the fuel will prematurely reach ignition temperature during the compression stroke. This undesirable phenomenon is known as auto-ignition or "knock", and creates inefficiencies in the engine operation. Accordingly, it is desirable to cool the cylinders and the cylinder head. However, cooling the cylinder head, especially the portions overlying the cylinders, is particularly troublesome because these areas are crowded with components and also because these areas experience particularly high heating. Moreover, cooling of the cylinder head at the area between adjacent cylinders is also problematic due to heat build up in this area.

The cylinder head typically defines a water jacket passageway through which cooling liquid flows. Due to the configuration of the water jacket passageway, especially the irregular enlargements that are created in the passageway portions overlying the "siamese area" between adjacent cylinders, there is a tendency for stagnation in the water flow, reducing the effectiveness of the cooling liquid at the areas that need cooled the most. Accordingly, areas of the cylinder head become overheated. Such localized overheating or inconsistent cooling of the cylinder head may lead to auto-ignition or knock. In response to this need, as shown by U.S. Pat. No. 4,690,104 and Japanese Laid-Open Application No. 56-148647, it has been proposed to constrict the water jacket passageway at the siamese area, thereby increasing the water velocity in the passageway at this area.

U.S. Pat. No. 5,799,627 discloses another attempt to provide more consistent cooling of the cylinder head. The '627 patent introduces trapezoid-shaped projections that extend downwardly from the top wall of the head. The projections are disposed relatively above each cylinder and in a plane extending essentially normal to the cooling fluid flow direction and constrict the cooling passageway at that area.

Other patents, such as U.S. Pat. Nos. 4,553,505; 4,889,079; and 5,086,733 teach ribs that extend upwardly into the cooling passageway from the bottom wall of the cylinder head.

Also, some of the structures known in the art are very large and heavy, to the detriment of weight and fuel efficiency. Others of the structures are not configured to optimize the flow characteristics of the coolant passageway. Accordingly, there exists a need in the art for a cylinder head having a light-weight and a configuration to ensure cooling thereof. There also exists a need in the art for a flow control device in the water jacket passageway that will assist cooling the cylinder head at the areas between adjacent cylinders and at the areas at both ends of the cylinder head.

SUMMARY OF THE INVENTION

In accordance with the present invention, an engine includes an engine block defining a plurality of cylinders and a cylinder head disposed on the engine block. The cylinder head includes first and second ends, as well as upper and lower walls that cooperate to define a water jacket passageway through which coolant flows from the first end of the cylinder head toward the second end of the cylinder head. The lower wall is disposed on the block so as to overlie or cover the plurality of cylinders. One of the cylinders is near the first end of the cylinder head and another of the cylinders is near the second end of the cylinder head. The lower wall has at least one prominence associated with each cylinder such that the lower wall adjacent each cylinder is relatively recessed as compared to the lower wall directly over the cylinders.

In accordance with one aspect of the present invention, a plurality of ribs extend downwardly from the upper wall toward the lower wall. The ribs are designed to enhance the transfer of heat to the coolant fluid from the head lower wall. At least one of the ribs is disposed between the first end of the cylinder head and a cylinder closest to the cylinder head first end. Another of the ribs is disposed between the second end of the cylinder head and a cylinder closest to the cylinder head second end.

In accordance with another aspect of the invention, a plurality of ribs are disposed in the water jacket passageway relatively between adjacent cylinders. The plurality of ribs have a first end and a second end. The ribs are connected to one another at their first ends and are spaced apart from one another at their second ends.

In further accordance with another aspect of the present invention, the ribs extending downwardly from the top wall between adjacent cylinders have a lower edge facing the lower wall. The lower edges of the ribs are spaced a predetermined, generally equal, distance from the lower wall.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
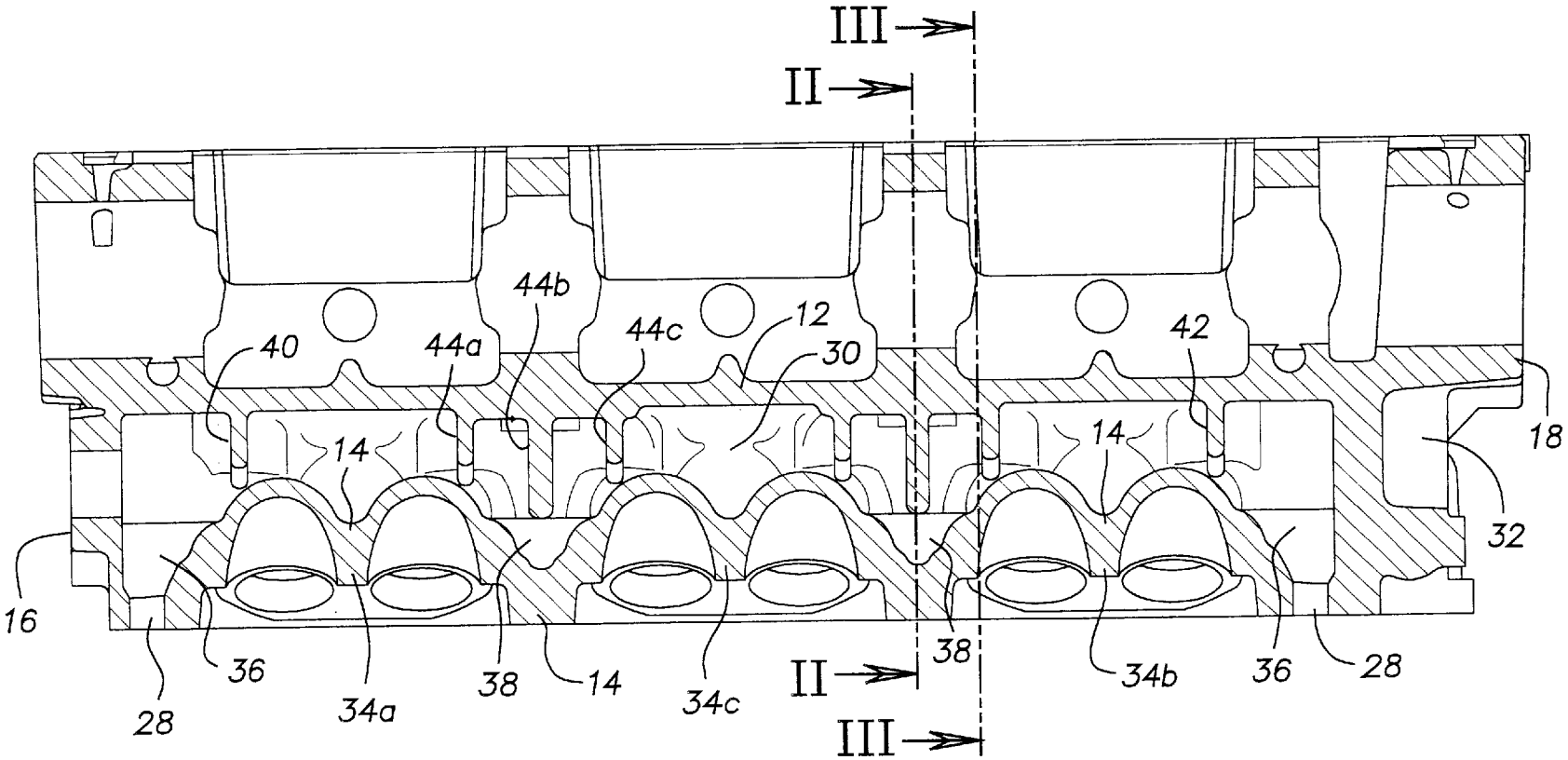
FIG. 1 is a longitudinal cross sectional view of the cylinder head according to the present invention, as seen along line I—I of FIG. 4.
Figure 2:
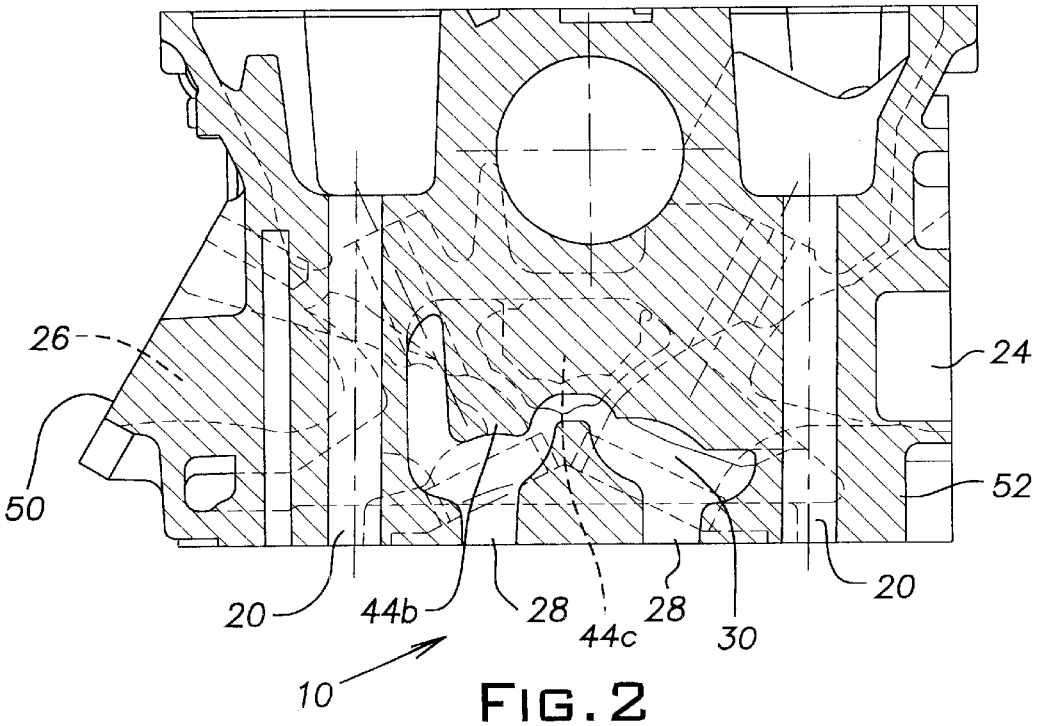
FIG. 2 is a cross-sectional view of the cylinder head according to the present invention as seen along line II—II of FIG. 1.
Figure 3:
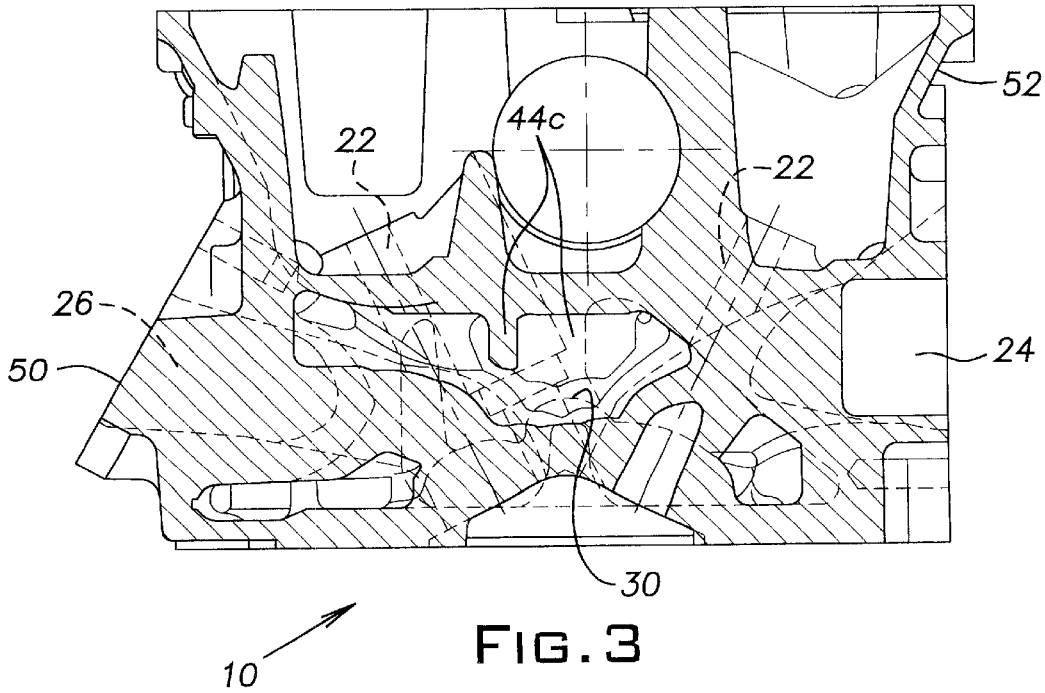
FIG. 3 is a cross-sectional view of the cylinder head according to the present invention as seen along line III—III of FIG. 1.

With reference to the drawings, the cylinder head 10 of the present invention is shown to include an upper wall 12, a lower wall 14, and first and second opposed end walls 16, 18. The cylinder head 10 also defines a series of openings 20 that receive fasteners (not shown) for securing the cylinder head to the engine block 21 (FIG. 5), openings 22 through which various engine components such as valves and spark plugs (not shown) extend, and a series of air inlet passageways 24 and exhaust gas outlet passageways 26. The cylinder head 10 also has coolant openings 28 by means of which coolant flowing through the engine block is introduced into the cylinder head. Coolant is introduced into the cylinder head 10 from the engine block 21 via the coolant openings 28, and the fluid passageways 23 in the engine block 21 are aligned with the coolant openings 28 in the lower wall 14 of the cylinder head 10. Insofar as each of these components, openings, and passageways is conventional, they will not be discussed farther herein.

The upper and lower walls 12, 14 cooperate to define a water jacket passageway 30 through which coolant flows from the inlets 28 to an outlet 32 at the second end wall 18. It is noted that the outlet 32, which is located relatively closer to the upper wall 12 than to the lower wall 14, also serves as vent through which gas bubbles may escape the cylinder head 10.

The lower wall 14 is secured to the face of the engine block 21, and portions of the lower wall serve as the top wall of the cylinder or combustion chamber. Each of the portions of the lower wall 14 that define the combustion chamber top walls 34*a*, 34*b*, 34*c* are aligned and associated with a cylinder 25 provided by the engine block 21. The portions of the cylinder head lower wall 14 that overlie a cylinder and serve as the combustion chamber top walls will hereinafter be referred to as the "cylinder top wall". Although in the illustrated and preferred embodiment of the cylinder head three such "cylinder top walls" and associated cylinders are provided, it is considered apparent that more or less than three may be used without departing from the scope and spirit of the present invention. Moreover, it is considered apparent that the engine will be adapted to receive one or more cylinder heads, as is known in the art.

As discussed hereinafter, the lower wall 14 of the cylinder head 10 includes a first cylinder top wall 34*a*, which is adjacent the first end wall 16 of the cylinder head 10, a second cylinder top wall 34*b*, which is adjacent the second end wall 18 of the cylinder head 10, and a third cylinder top wall 34*c*, which is between the first and second cylinder top walls 34*a*, 34*b*. It is noted that the lower wall 14 of the cylinder head 10 has at least one prominence or raised area (FIG. 1) coinciding with each of the cylinder top walls 34*a*, 34*b*, 34*c*, and that the areas surrounding the cylinder top walls 34*a*, 34*b*, 34*c* are recessed relative to the prominence or raised area.

More specifically, relatively before the first cylinder top wall 34*a* (i.e., between the cylinder top wall 34*a* and the first end wall 16 of the cylinder head 10) and relatively after the second cylinder top wall 34*b* (i.e., between the second cylinder top wall 34*b* and the second end wall 18 of the cylinder head 10) there is a recessed area 36, and between adjacent cylinder top walls 34*a*, 34*c*; 34*c*, 34*b* there is a recessed area 38. It is believed that, prior to the present invention, coolant flow in these recessed areas 36, 38 was relatively stagnant and, thus, limited the heat exchanged from the lower wall 14 of the cylinder head 10 to the coolant flowing in the water jacket passageway 30, and may have resulted in areas of high-temperature in the cylinder top walls 34*a*, 34*b*, 34*c* or cylinder 25.

Figure 4:
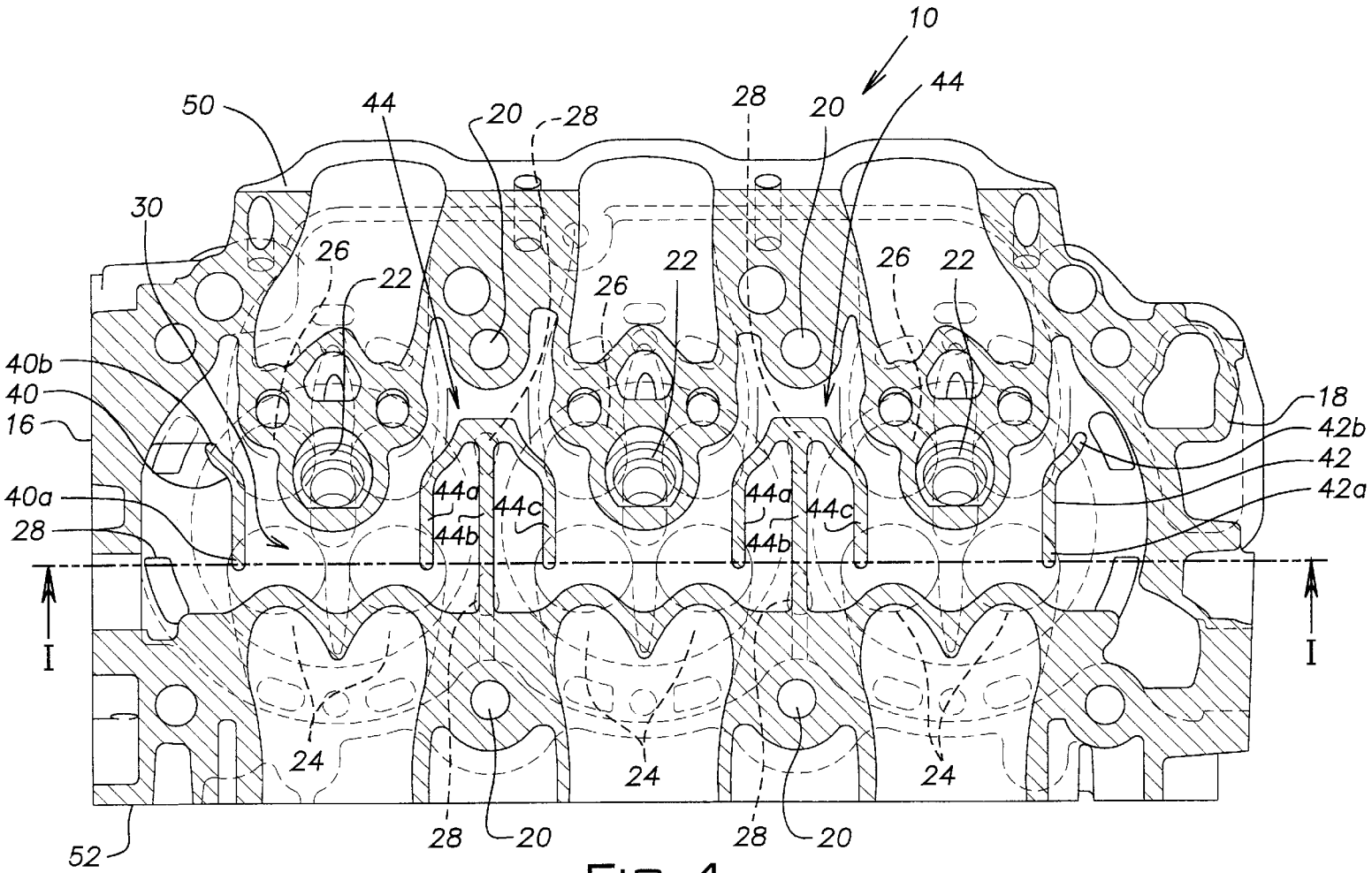
FIG. 4 is a longitudinal cross-sectional view of the cylinder head according to the present invention; and, FIG. 5 schematically illustrates a longitudinal section of the cylinder head in a simplified form to illustrate coolant flow through the water jacket passageway.
Figure 5:
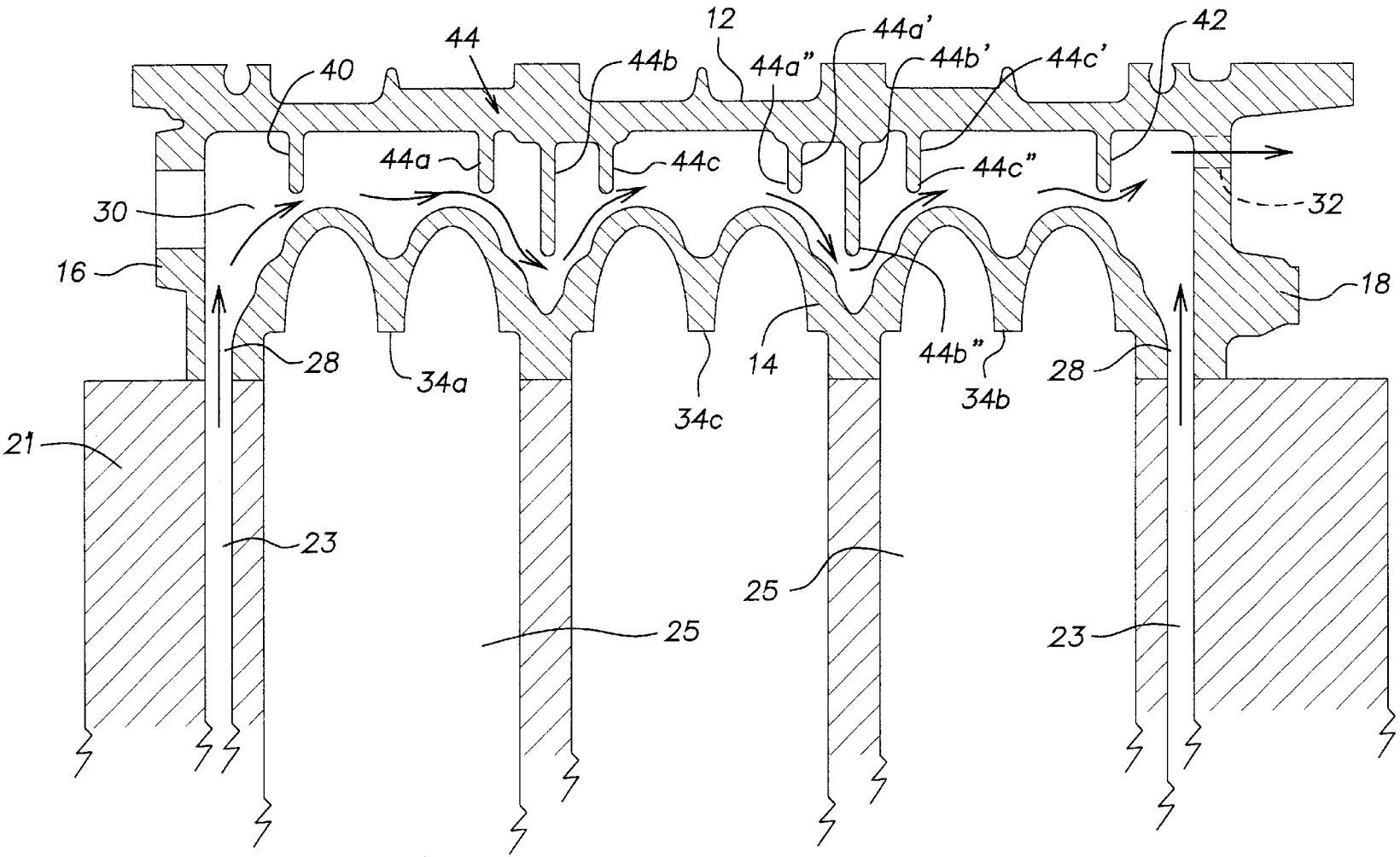

With reference to FIGS. 1, 4, and 5, a series of ribs or baffles is shown to extend downwardly from the upper wall 12 toward the lower wall 14. Each of the ribs has a length direction that is generally transverse to the length direction of the water jacket passageway 30, as illustrated.

The ribs include a first or inlet rib 40, a second or outlet rib 42, and a pair of connected rib sets 44. The first or inlet rib 40 is disposed between the first end wall 16 of the cylinder head 10 and the first cylinder top wall 34*a*. The second or outlet rib 42 is disposed between the second cylinder top wall 34*b* and the second end wall 18 of the cylinder head 10. Each of the illustrated rib sets 44 is disposed between adjacent cylinder top walls (34*a*, 34*c*; 34*c*, 34*b*), and defines a forked structure comprising three ribs 44*a*, 44*b*, 44*c*. Each of the three ribs 44*a*, 44*b*, 44*c* of the set have a first end that is connected to the other ribs of the set, and a second end that is spaced from the other ribs of the set. Moreover, and as will be discussed more fully hereinafter, each of the ribs has an upper edge 44*a'*, 44*b'*, 44*c'* integrally formed with the upper wall 12 and a lower edge 44*a"*, 44*b"*, 44*c"* facing toward the lower wall 14. Preferably, the lower edges 44*a"*, 44*b"*, 44*c"* of each of the ribs of the set is spaced from the lower wall a predetermined and substantially equal distance.

The use of three ribs is preferred. However, a person of ordinary skill in the art will be able to select an appropriate number of ribs and adjust the rib thickness and spacing in dependence upon the materials used and the space available in a particular cylinder head. Therefore, the present invention is not to be limited to the preferred embodiment described herein.

With reference to FIG. 4, the cylinder head 10 is illustrated to have an exhaust side 50 and an intake side 52. The water jacket passageway 30, which is defined in the cylinder head to have a rather complex shape, is shown to extend generally further toward the exhaust side 50 than the intake side 52 due, in part, to the greater need for cooling on the exhaust side 50 of the cylinder head. With continued reference to FIG. 4, the first or inlet rib 40 has a first end 40*a* facing the intake side 52 of the cylinder head and a second end 40*b* facing the exhaust side 50 of the cylinder head 10. The second end 40*b* of the inlet rib 40 is curved or angled toward the first end wall 16. Similarly, the second or outlet rib 42 has a first end 42*a* facing the intake side 52 of the cylinder head and a second end 42*b* facing the exhaust side 50 of the cylinder head 10. The second end 42*b* of the outlet rib 42 is curved or angled toward the second end wall 18.

The sets of ribs 44 between the first and third cylinder top walls 34*a*, 34*c* and between the second and third cylinder top walls 34*b*, 34*c* are preferably identical to one another. Each set of ribs includes a center rib 44*b* and first and second lateral ribs 44*a*, 44*c*. The center rib 44*b* and lateral ribs 44*a*, 44*c* have a first end facing toward the exhaust side 50 of the cylinder head and a second end facing toward the intake side 52 of the cylinder head. As noted previously, the first end of the center rib 44*b* is connected to the first end of the lateral ribs 44*a*, 44*c* and the second end of the center rib 44*b* is spaced from the second end of each of the lateral ribs 44*a*, 44*c*.

With reference to FIG. 5, the ribs 40, 42, 44 according to the present invention are illustrated to extend downwardly from the upper wall 12 toward the lower wall 14. The ribs serve to constrict the flow at areas of the lower wall (cylinder top walls 34*a*, 34*b*, 34*c*) that had previously tended to overheat. More specifically, the inlet rib 40 serves to conduct or direct the coolant downwardly over the edges of the first cylinder top wall 34*a*. The outlet rib 42 forces coolant downwardly so as to flow over the downstream edge of the second cylinder top wall 34*b* as the coolant flows to the outlet 32. The pair of rib sets 44 serve to force or direct coolant into and over the spaces between adjacent cylinder top walls (34*a*, 34*c*; 34*c*, 34*b*).

Providing a plurality of ribs instead of a single monolithic rib is advantageous for a number of reasons. For example, a plurality of ribs uses less material, and thus is less expensive to mold and results in a lighter head. Also, providing a plurality of ribs may create more turbulent flow, enhancing the transfer of heat from the lower wall.

Typically, the head 10 is disposed on the engine block 21 in an angled orientation such that the intake side 52 of the head is relatively higher than the exhaust side 50 of the head. As such, it is desirable that the open or second ends of the set of ribs are disposed at the inlet side, as illustrated, so as to permit any bubbles or air to escape from between the center 44*b* and lateral ribs 44*a,* 44*c*.

The present invention has been described herein with particularity, but it is noted that the scope of the invention is not limited thereto. Rather, the present invention is considered to be possible of numerous modifications, alterations, and combinations of parts and, therefore, is only to be defined by the claims appended hereto.

What is claimed is:

1. An engine comprising;

an engine block having a plurality of cylinders;

a cylinder head having first and second ends, an upper wall and a lower wall, said lower wall defining a plurality of cylinder top walls, said cylinder head being disposed on said engine block such that each of said plurality of cylinder top walls overlie a corresponding one of said plurality of cylinders, a first of said plurality of cylinder top walls being located near said first end of said cylinder head and a second of said plurality of cylinder top walls being near said second end of said cylinder head, said cylinder head lower wall having at least one prominence at each of said cylinder top walls such that said lower wall adjacent said cylinder top walls is relatively recessed as compared to said lower wall at said cylinder top walls, said upper wall being spaced from said lower wall and cooperating with said lower wall to at least partially define a water jacket passageway through which fluid flows through said head from said first end toward said second end; and, a plurality of ribs extending downwardly from said upper wall toward said lower wall, one of said plurality of ribs being disposed between one of said first and second ends of said head and an associated one of said first and second cylinder top walls, and wherein said plurality of ribs includes at least one set of ribs disposed relatively between adjacent cylinder top walls, each of said at least one set of ribs comprising a plurality of individual ribs.

2. The engine according to claim 1, wherein said one of said plurality of ribs is disposed between the first end of said cylinder head and said first cylinder top wall, and another of said plurality of ribs is disposed between the second end of said cylinder head and said second cylinder top wall.

3. The engine according to claim 1, wherein each of said plurality of individual ribs in said at least one set of ribs have a first end and a second end, said individual ribs being connected to one another at said first end and being spaced apart from one another at said second end.

4. The engine according to claim 3, wherein each of said plurality of individual ribs in said at least one set of ribs has a bottom edge that is spaced from said lower wall a predetermined distance.

5. An engine according to claim 3, wherein said one of said plurality of ribs is disposed between the first end of said cylinder head and said first cylinder top wall, and another of said plurality of ribs is disposed between the second end of said cylinder head and said second cylinder top wall.

6. An engine, comprising:

an engine block having a plurality of cylinders;

a cylinder head having first and second ends, an upper wall and a lower wall, said lower wall defining a plurality of cylinder top walls, said cylinder head being disposed on said engine block such that each of said plurality of cylinder top walls overlie a corresponding one of said plurality of cylinders, said cylinder top walls having at least one prominence such that said lower wall adjacent the cylinder top walls is relatively recessed as compared to said cylinder top wall, said upper wall being spaced from said lower wall and cooperating with said lower wall to at least partially define a water jacket passageway through which fluid flows through said cylinder head from said first end toward said second end; and, a plurality of ribs extending downwardly from said upper wall toward said lower wall, said plurality of ribs including a series of interconnected ribs that are disposed between adjacent cylinder top walls.

7. The engine according to claim 6, wherein a first of said plurality of cylinder top walls is near said first end of said cylinder head and one of said plurality of ribs is disposed between said first end of said cylinder head and said first cylinder top wall.

8. The engine according to claim 7, wherein a second of said plurality of cylinder top walls is near said second end of said cylinder head, and wherein another of said plurality of ribs is disposed between said second end of said cylinder head and said second cylinder top wall.

9. The engine according to claim 6, wherein one of said plurality of cylinder top walls is near said second end of said cylinder head and one of said plurality of ribs is disposed between said second end of said cylinder head and said one of said plurality of cylinder top walls.

10. The engine according to claim 6, wherein said series of interconnected ribs have a first end and a second end, said ribs being connected to one another at said first end and being spaced apart from one another at said second end.

11. The engine according to claim 10, wherein said head is disposed on the block such that said second end of said interconnected ribs is vertically higher than said first end of said interconnected ribs so as to permit air to escape from between said interconnected ribs.

12. An engine, comprising:

an engine block having a plurality of cylinders;

a cylinder head having first and second ends, all upper wall and a lower wall, said lower wall defining a plurality of cylinder top walls, said cylinder head being disposed on said engine block such that each of said plurality of cylinder top walls overlie a corresponding one of said plurality of cylinders, each of said cylinder top walls including at least one prominence such that said lower wall adjacent the cylinder top walls is relatively recessed as compared to said lower wall at said cylinder top walls, said upper wall being spaced from said lower wall and cooperating with said lower wall to at least partially define a water jacket passageway through which fluid flows through said cylinder head from said first end toward said second end; and, a plurality of ribs extending downwardly from said upper wall toward said lower wall, said plurality of ribs including at least first and second ribs that are disposed between a first cylinder top wall and an adjacent second cylinder top wall, said at least first and second ribs having lower edges that face said lower wall, and wherein said at least first and second ribs lower edges are spaced a substantially identical distance from said lower wall.

13. The engine according to claim 12, wherein said plurality of ribs includes a third rib that is disposed adjacent said at least first and second ribs, said third rib having a lower edge facing said lower wall and said third rib lower edge being spaced from said lower wall a distance substantially equal to the distance that said first and second ribs lower edges are spaced from said lower wall.

14. The engine according to claim 13, wherein said first, second and third ribs are connected to one another.

15. The engine according to claim 14, wherein one of said plurality of cylinder top walls is near said first end of said cylinder head and one of said plurality of ribs is disposed between said first end of said cylinder head and said one of said plurality of cylinder top walls.

16. The engine according to claim 15, wherein another of said plurality of cylinder top walls is near said second end of said cylinder head, and wherein another of said plurality of ribs is disposed between said second end of said cylinder head and said another of said plurality of cylinder top walls.

17. The engine according to claim 14, wherein one of said plurality of cylinder top walls is near said second end of said cylinder head and one of said plurality of ribs is disposed between said second end of said cylinder head and said one of said plurality of cylinder top walls.

18. The engine according to claim 14, wherein said cylinder head is disposed on the engine block such that a second end of said interconnected ribs is vertically higher than a first end of said interconnected ribs so as to permit air to escape from between said interconnected ribs.

* * * * *